US006266509B1

(12) United States Patent
Ota et al.

(10) Patent No.: US 6,266,509 B1
(45) Date of Patent: Jul. 24, 2001

(54) FIXING APPARATUS

(75) Inventors: Mitsuhiro Ota, Susono; Rie Saito, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/352,877

(22) Filed: Jul. 13, 1999

(30) Foreign Application Priority Data

Jul. 15, 1998 (JP) ..... 10-216425

(51) Int. Cl.[7] ..... G03G 15/20
(52) U.S. Cl. ..... 399/325
(58) Field of Search ..... 355/284; 399/33, 399/43, 324, 325, 326

(56) References Cited

U.S. PATENT DOCUMENTS 4,045,165 * 8/1977 Nakajima et al. ..... 399/324
5,157,445 * 10/1992 Shoji et al. ..... 399/325
5,353,107 * 10/1994 Sculley et al. ..... 399/324
5,392,105 * 2/1995 Moser ..... 399/324
5,424,819 * 6/1995 Menjo ..... 399/325
5,835,833 * 11/1998 Dalal et al. ..... 399/325
5,937,257 * 8/1999 Condello et al. ..... 399/324

* cited by examiner

*Primary Examiner*—Quana M. Grainger
(74) *Attorney, Agent, or Firm*—Fitzpatrick, Cella, Harper & Scinto

(57) ABSTRACT

A fixing apparatus includes a rotary member for thermally fixing a nonfixed image to a recording material, and a mold releasing agent applying device for applying a mold releasing agent to the rotary member. The mold releasing agent applying device has a regulating member contacted with the rotary member to regulate an amount of the mold releasing agent supplied to the rotary member. A holding member is disposed at an upstream side of the regulating member in a rotating direction of the rotary member and is adapted to hold the mold releasing agent. A supplying member supplies the mold releasing agent to the holding member, wherein a supplying timing of the mold releasing agent supplied from the supplying member to the holding member is effected periodically after a plurality of fixing process operations.

4 Claims, 5 Drawing Sheets

FIXING APPARATUS

BACKGROUND OF THE INVENTION

1. Field of the Invention

The present invention relates to an image forming apparatus of an electrophotographic type or an electrostatic recording type such as a copying machine, a laser beam printer and the like, and a fixing apparatus mounted to such an image forming apparatus.

2. Related Background Art

In a fixing apparatus mounted to an image forming apparatus such as a laser beam printer, generally, a pressure roller is urged against a fixing roller (fixing rotary member) having a heater therein to form a fixing nip therebetween, and, while a recording material bearing a non fixed toner image is being passed through the fixing nip, by heat and pressure, the non fixed toner image is fixed onto the recording material as a permanent image.

Further, the fixing roller normally has a mechanism for coating or applying a mold releasing agent (oil) to prevent toner offset and to improve a mold releasing ability.

In such mold releasing agent coating mechanisms, it is known to provide a system in which an oil supplying pump is used to supply oil to an oil dripping pipe from which the oil is in turn dripped onto a cleaning felt or a fixing roller, and the oil is uniformly coated on the fixing roller by a regulating blade, and excessive oil is passed through the regulating blade and is collected in an oil pan for re-use.

However, the above-mentioned system in which the oil is regulated by the regulating blade is greatly influenced by the viscosity of the oil.

For example, in the case of oil having high viscosity, a larger amount of oil tends to pass through the regulating blade, thereby increasing the oil coating amount. Further, the viscosity of oil is varied with a temperature of the oil, and, particularly, when the viscosity of the oil is great immediately after replenishment of oil, the oil coating amount is increased. In this way, the oil coating becomes unstable.

SUMMARY OF THE INVENTION

An object of the present invention is to provide a fixing apparatus which can stabilize coating of mold releasing agent onto a fixing rotary member.

Another object of the present invention is to provide a fixing apparatus in which mold releasing agent is supplied from a mold releasing agent supplying member to a mold releasing agent holding member every several fixing processes.

The other objects and features of the present invention will be apparent from the following detailed explanation of the invention.

DESCRIPTION OF THE PREFERRED EMBODIMENTS

Now, a fixing apparatus and an image forming apparatus according to the present invention will be fully described with reference to the accompanying drawings.

First Embodiment

Figure 2:
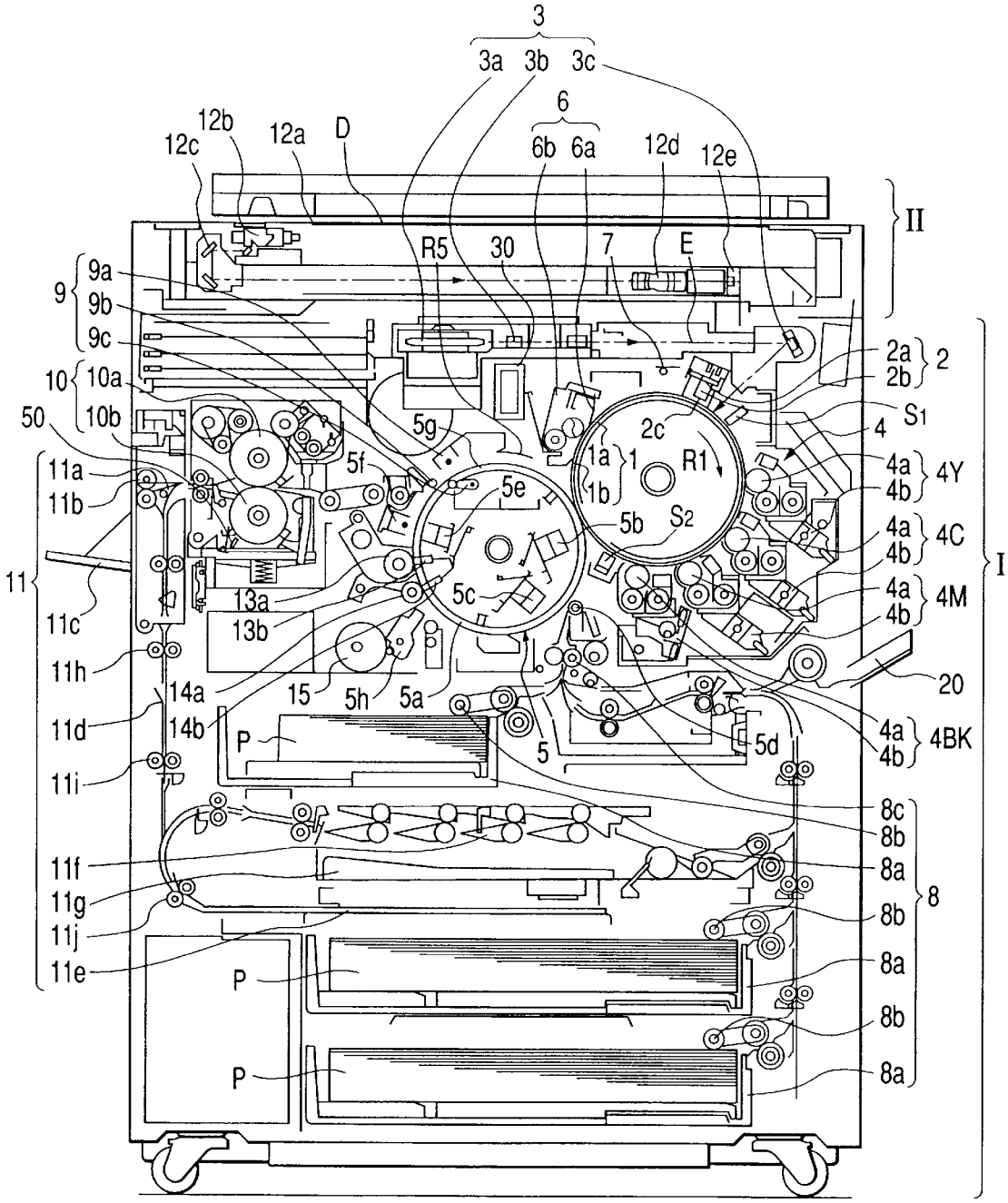
FIG. 2 is a constructural view showing an embodiment of a full-color image forming apparatus having the fixing apparatus of FIG. 1.

FIG. 2 is a schematic constructural view of a four-color, full-color image forming apparatus of digital type as an example of an image forming apparatus having a fixing apparatus according to the present invention.

The image forming apparatus shown in FIG. 2 includes a lower digital color image printer portion (referred to merely as "printer portion" hereinafter) I, and an upper digital color image reader portion (referred to merely as "reader portion" hereinafter) II and serves to form an image on a recording material P by the printer portion I on the basis of an image of an original D read by the reader portion II, for example.

Now, constructions of the printer portion I and the reader portion II will be described in order.

The printer portion I has a photosensitive drum 1 as an image bearing body rotated in a direction shown by the arrow R1. Around the photosensitive drum 1, along the rotational direction thereof, in order, there are disposed a primary charger (charging means) 2, an exposing means 3, a developing apparatus (developing means) 4, a transferring device 5, a cleaning device 6, and a pre-exposure lamp 7. Below the transferring device 5, i.e., at a lower half of the printer portion I, there is disposed a feed and convey portion 8 for the recording material P, and a separation means 9 is disposed above the transferring device 5, and a fixing apparatus 10 and a sheet discharge portion 11 are disposed at a downstream side of the separation means 9 (downstream side in a recording material P conveying direction).

The photosensitive drum 1 has a drum-shaped aluminium core member 1*a*, and an OPC (organic photosemiconductor) photosensitive layer 1*b* coated on a surface of the core member and is rotated in the direction R1 by a driving means (not shown) at a predetermined process speed (peripheral speed). Incidentally, the photosensitive drum 1 will be fully described later.

The primary charger 2 is a corona charger including a shield 2*a* having an opening opposed to the photosensitive drum 1, a discharge wire 2*b* disposed within the shield 2*a* in parallel with a generatrix of the photosensitive drum 1, and a grid 2*c* disposed in the opening of the shield 2*a* and adapted to regulate charging potential. A charging bias is applied to the primary charger 2 from a power source (not shown), so that the surface of the photosensitive drum 1 is uniformly charged with a predetermined polarity and a predetermined potential.

The exposing means 3 includes a laser output portion (not shown) for emitting a laser beam in response to an image signal from the reader portion II, a polygon mirror 3*a* for reflecting the laser beam, a lens 3*b* and a mirror 3*c*. The exposing means 3 serves to expose the photosensitive drum 1 by illuminating the laser beam onto the surface of the photosensitive drum 1 to remove electric charges from the exposed portion, thereby forming an electrostatic latent image. In the illustrated embodiment, the electrostatic latent image formed on the surface of the photosensitive drum 1 is color-decomposed into four color (yellow, cyan, magenta and black) components on the basis of the image of the original, and the electrostatic latent images corresponding to such color components are successively formed.

The developing apparatus 4 includes four developing devices 4Y, 4C, 4M and 4Bk containing yellow toner (having resin as a base substance), cyan toner, magenta toner and black toner, respectively, which developing devices are disposed along the rotational direction (R1) of the photosensitive drum 1 in order from the upstream side thereof. Each of the developing devices 4Y, 4C, 4M and 4Bk has a developing sleeve 4*a* for electrostatically adhering the toner to the electrostatic latent image formed on the surface of the photosensitive drum 1, and the predetermined developing device selected to develop the electrostatic latent image is brought to a developing position near the surface of the photosensitive drum 1 by an eccentric cam 4*b*. In the developing position, the toner is adhered onto the electrostatic latent image by the developing sleeve 4*a*, thereby effecting development to form a toner image (visualized image). Incidentally, the other three developing devices other than the developing device selected for development are retarded from the developing position.

The transferring device 5 includes a transfer drum (recording material bearing body) 5*a* having a surface for bearing the recording material P, a transfer charger (transfer charger means) 5*b* for transferring the toner image formed on the photosensitive drum 1 onto the recording material P, an absorption charger 5*c* for absorbing the recording material P to the transfer drum 5*a* and an opposed absorbing roller 5*d*, an internal charger 5*e* and an external charger 5*f*. A cylindrical recording material bearing sheet 5*g* made of dielectric material is integrally mounted with tension at a circumferential opening portion of the transfer drum 5*a* rotatably supported for rotation in a direction shown by the arrow R5. The recording material bearing sheet 5*g* is formed from a dielectric sheet such as a polycarbonate film. The transferring device 5 serves to adsorb and bear the recording material P on the surface of the transfer drum 5*a*.

The cleaning device 6 includes a cleaning blade 6*a* for scraping residual toner remaining on the surface of the photosensitive drum 1 (which was not transferred to the recording material P), and a cleaning container 6*b* for collecting the scraped toner.

The pre-exposure lamp 7 is disposed near and at an upstream side of the primary charger 2 and serves to remove undesired electric charges from the surface of the photosensitive drum 1 cleaned by the cleaning device 6.

The feed and convey portion 8 includes a plurality of sheet feed cassettes 8*a* capable of stacking and containing recording materials P having different sizes, sheet feed rollers 8*b* for feeding the recording materials P from the corresponding sheet feed cassettes 8*a*, a plurality of convey rollers, and a pair of registration rollers 8*c* and serves to supply the recording material P having a predetermined size to the transfer drum 5*a*.

The separation means 9 includes a separation charger 9*a* for separating the recording material P from the transfer drum 5*a* after the toner images were transferred to the recording material, a separation claw 9*b*, and a separation and push-up subroller 9*c*.

The fixing apparatus 10 includes a fixing roller 10*a* having a heater therein, and a pressure roller 10*b* disposed below the fixing roller 10*a* and adapted to urge the recording material P against the fixing roller 10*a*.

The sheet discharge portion 11 includes a convey path switching guide 11*a* disposed at a downstream side of the fixing apparatus 10, discharge rollers 11*b*, and a sheet discharge tray 11*c*. Further, below the convey path switching guide 11*a*, there are disposed a convey vertical path lid, a reversing path lie, a stacking member 11*f*, an intermediate tray 11*g*, and pairs of convey rollers 11*h*, 11*i*, 11*j*, which constitute a mechanism for forming images on both surfaces of a single recording material P.

Further, around the photosensitive drum 1, a potential sensor S1 for detecting the charged potential of the surface of the photosensitive drum 1 is disposed between the primary charger 2 and the developing apparatus 4, and a density sensor S2 for detecting density of the toner image on the photosensitive drum 1 is disposed between the developing apparatus 4 and the transfer drum 5*a*.

Now, the reader portion II will be described. The reader portion II disposed above the printer portion I includes an original glass plate 12*a* on which the original D is rested, an exposure lamp 12*b* for exposing and scanning an imaged surface of the original D while shifting, a plurality of mirrors 12*c* for further reflecting light reflected from the original D, a lens 12*d* for collecting the reflected light, and a full-color sensor 12*e* for forming a color decomposed image signal on the basis of the light from the lens 12*d*. The color decomposed image signal is sent through an amplifier circuit (not shown), to a video processing unit (not shown), where the signal is processed, and the processed signal is sent to the printer portion 1.

Next, an operation of the image forming apparatus having the above-mentioned construction will be briefly described, with explanation of additional construction. Incidentally, in the following explanation, it is assumed that an yellow image, a cyan image, a magenta image and a black image are successively formed to obtain a full-color image.

The image of the original D rested on the original glass plate 12*a* of the reader portion II is read by the exposure lamp 12*b* and then is sent to the printer portion I as the processed signal.

In the printer portion I, while the photosensitive drum 1 is being rotated in the direction R1, the surface of the drum is uniformly charged by the primary charger 2. On the basis of the image signal sent from the above reader portion II, the laser beam is emitted from the laser output portion of the exposing means 3, so that the charged surface of the photosensitive drum 1 is exposed by a light image E through the polygon mirror 3*a*. The electric charges are removed from the exposed surface of the photosensitive drum 1, thereby forming the electrostatic latent image corresponding to an yellow image. In the developing apparatus 4, the yellow developing device 4Y is brought to the predetermined developing position and the other developing devices 4C, 4M, 4Bk are retarded from the developing position. The yellow toner is adhered to the electrostatic latent image on the photosensitive drum 1 by the developing device 4Y to visualize the latent image as an yellow toner image. The yellow toner image formed on the photosensitive drum 1 is transferred onto the recording material P borne on the transfer drum 5*a*. The recording material P having the size optimum to the image is supplied from the predetermined sheet feed cassette 8*a* to the transfer drum 5*a* at a predetermined timing through the sheet feed roller 8*b*, convey roller and the registration rollers 8*c*. The recording material P supplied in this way is adsorbed by and wound around the surface of the transfer drum 5*a* and is shifted in the direction R5; meanwhile, the yellow toner image formed on the photosensitive drum 1 is transferred onto the recording material by the transfer charger 5*b*.

On the other hand, after the toner image is transferred, the residual toner remaining on the surface of the photosensitive drum 1 is removed by the cleaning device 6, and then, the undesired electric charges are removed by the pre-exposure lamp 7 for preparing for next image formation starting from the primary charging.

The above-mentioned series of processes starting from the reading of the original image effected by the reader portion II and including the transferring process for transferring the toner image onto the recording material P on the transfer drum 5*a* and the cleaning and electricity removing processes for the photosensitive drum 1 are similarly effected with respect to the cyan, magenta and black images, respectively, as well as the yellow image, with the result that four color toner images are transferred onto the transfer material P on the transfer drum 5*a* in a superimposed fashion.

The recording material P to which the four color toner images were transferred is separated from the transfer drum 5*a* by the separation charger 9*a* and the separation claw 9*b*, and the separated recording material is conveyed to the fixing apparatus 10 in a condition that the non-fixed toner images are borne on the surface of the recording material. The recording material P is heated and pressurized by the fixing roller 10*a* and the pressure roller 10*b*, with the result that the toner images are melted and then solidified to be fixed to the recording material. After the fixing, the recording material P is discharged onto the sheet discharge tray 11*c* by the discharge rollers 11*b*.

Incidentally, when the images are to be formed on both surfaces of the recording material P, immediately after the recording material P is discharged from the fixing apparatus 10, the convey path switching guide ll*a* is operated to temporarily introduce the recording material into the reversing path lie through the convey path lid. Thereafter, by rotating the reversing rollers 11*j* in a reverse direction, the recording material is returned to a direction opposite to the direction along which the recording material is introduced into the path, with a trailing edge of the recording material (which was a leading edge when the recording material is introduced) directing toward the returning direction, thereby sending the recording material onto the intermediate tray 11*g*. Thereafter, an image is formed on the other surface of the recording material in the same image forming manner. Then, the recording material is discharged onto the sheet discharge tray 11*c*.

After the recording material P is separated, in order to prevent scattering of toner powder onto the recording material bearing sheet 5*g* of the transfer drum 5*a* and adhering of oil from the recording material P to the recording material bearing sheet, the cleaning is effected by using a fur brush 13 and a back-up brush 13*b* which are opposed to each other with the interposition of the recording material bearing sheet 5*g* and an oil removing roller 14*a* and a back-up brush 14*b* which are opposed to each other with the interposition of the recording material bearing sheet 5*g*. Incidentally, such cleaning is effected before or after the image formation and is always effected after sheet jam treatment.

Next, the fixing apparatus 10 will be explained with reference to FIG. 1.

Figure 1:
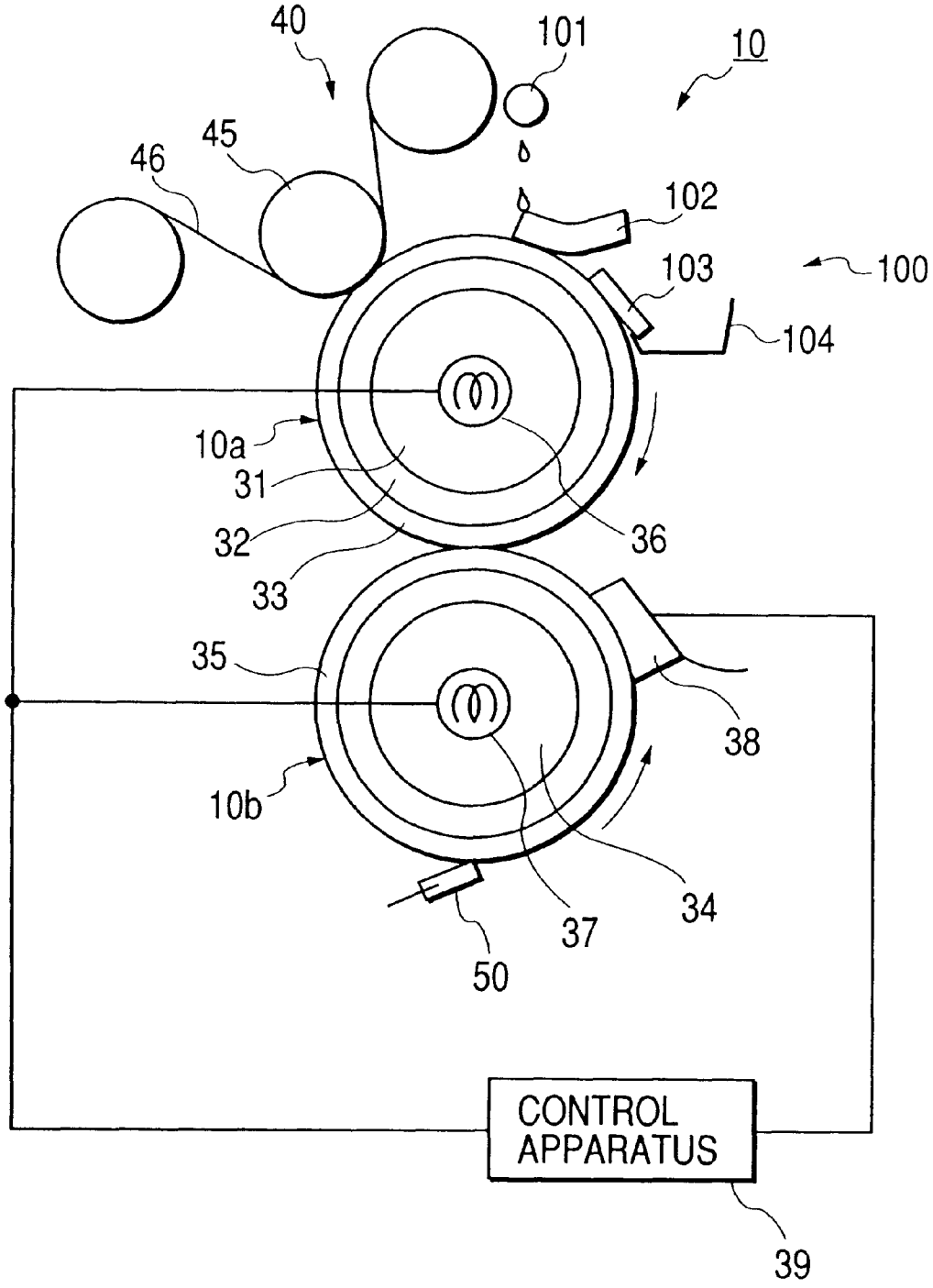
FIG. 1 is a constructural view showing a fixing apparatus according to an embodiment of the present invention.

In FIG. 1, the fixing roller (fixing rotary member) 10*a* contacting with the toner image is constituted by an aluminium core cylinder 31, an HTV (high temperature vulcanizing type) silicone rubber layer 32 coated on the core cylinder and having a thickness of 1 mm, and a special additional type silicone rubber layer 33 coated on the layer 32 so that an outer diameter of the fixing roller becomes 60 mm.

On the other hand, the pressure roller (fixing rotary member) 10*b* is constituted by an aluminium core cylinder 34, an HTV silicone rubber layer coated on the core cylinder and having a thickness of 1 mm, and a special additional type silicone rubber layer 35 coated on the layer 32 and having a thickness of 1 mm so that an outer diameter of the pressure roller becomes 60 mm.

The fixing roller 10*a* is provided with a heater (heat generating means) 36 disposed within the core cylinder 31, and the pressure roller 10*b* is provided with a heater 37 disposed within the core cylinder 34, so that the recording material P is heated from both sides. A temperature of the pressure roller 10*b* is detected by a thermistor 38 contacted with the pressure roller 10*b*. On the basis of the detected temperature, the halogen heaters 36, 37 are controlled by a control apparatus 39 so that the temperatures of the fixing roller 10*a* and the pressure roller 10*b* are both maintained to a constant value of 170° C. Incidentally, the fixing roller 10*a* and the pressure roller 10*b* are urged against each other with total pressure of about 80 kg by a pressurizing mechanism (not shown).

Further, as shown in FIG. 1, there are provided an oil applying device (mold releasing agent applying means) 100, a cleaning device 40, and a cleaning blade 50 for removing oil and contaminants from the pressure roller 10*b*.

In the oil applying device 100, silicone oil (referred to merely as "oil" hereinafter) is supplied from an oil supplying pump (not shown) to an oil dripping pipe (mold releasing agent supplying member) 101 in a dripping manner, and then, the oil is dripped from the pipe onto a cleaning felt (mold releasing agent holding member) 102 or the fixing roller 10*a*. And, the oil is uniformly coated on the fixing roller 10*a* by a regulating blade (mold releasing agent regulating member) 103. Excessive oil is passed through on the regulating blade 103 and is collected in an oil pan 104 for re-use.

The cleaning device 40 serves to clean the surface of the fixing roller 10*a* by means of a web 46 urged against the fixing roller 10*a* by an abutting roller 45.

In the above-mentioned fixing apparatus 10, the recording material P having the surface on which the nonfixed toner images are borne is conveyed through the fixing nip between the fixing roller 10*a* and the pressure roller 10*b*; meanwhile, the recording material is heated and pressurized from both sides, thereby fixing the toner images onto the recording material. The toners adhered to the fixing roller 10*a* and the pressure roller 10*b* in this case a re removed by the cleaning device 40 and the cleaning blade 50, respectively.

Next, the oil applying device 100 of the fixing apparatus which is a characteristic portion of the present invention will be further explained with reference to FIGS. 3 to 5.

As explained in connection with FIG. 1, although the regulating blade 103 of the oil applying device 100 serves to uniformly distribute the oil supplied from the oil dripping pipe 101, when the oil is supplied from the pipe 101, an amount of oil passing through the regulating blade 103 (i.e., oil applying amount) depends upon the viscosity of the oil.

The reason why the oil applying amount depends upon the viscosity of the oil is considered that, in case of oil having low viscosity, the oil can easily be distributed on the fixing roller 10*a* uniformly by the regulating blade 103, but, in case of oil having high viscosity, the regulating blade 103 becomes hard to uniformly distribute the oil, thereby passing the oil through the regulating blade.

Figure 3:
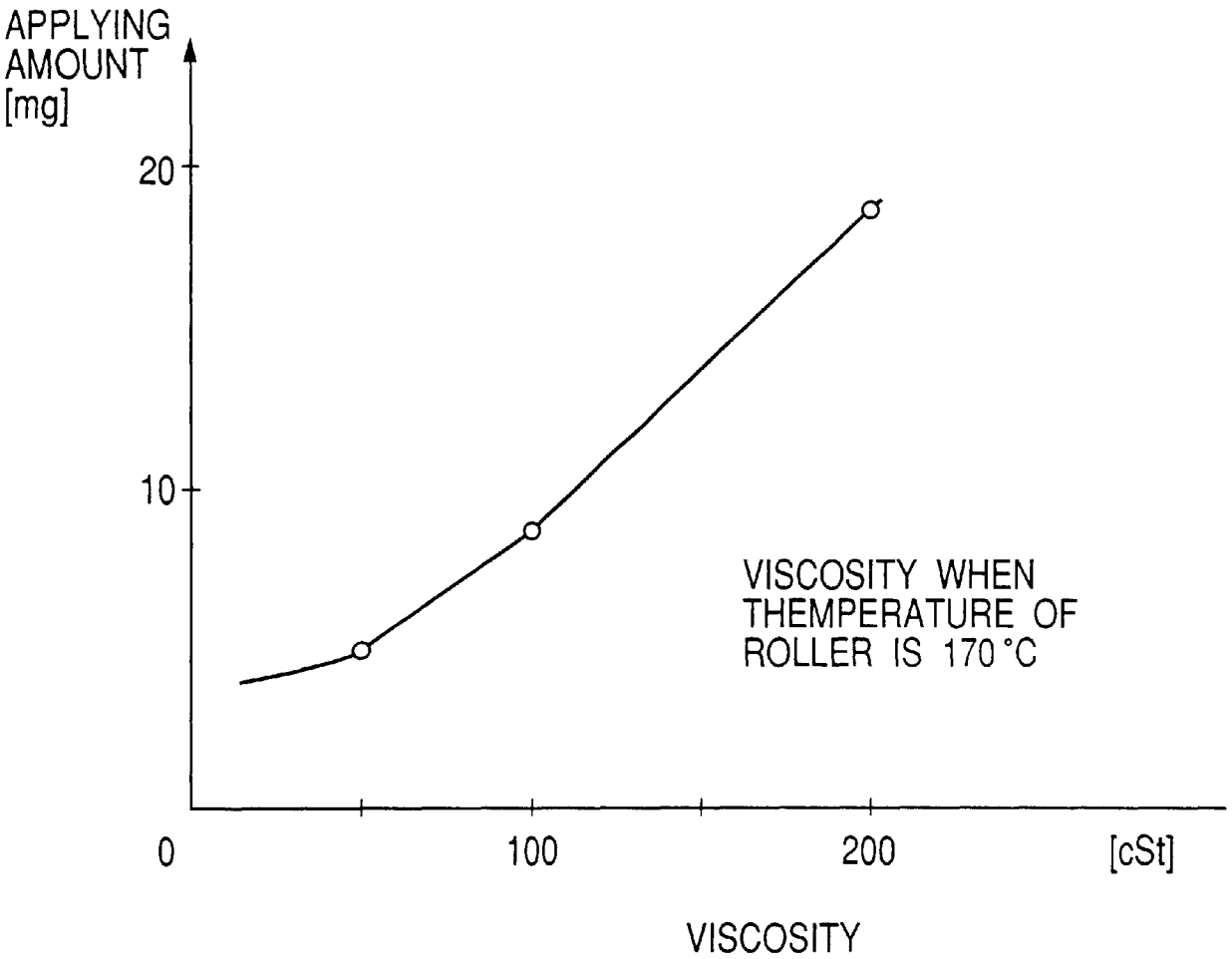
FIG. 3 is a graph showing a relationship between an oil applying amount and viscosity of oil.
Figure 4:
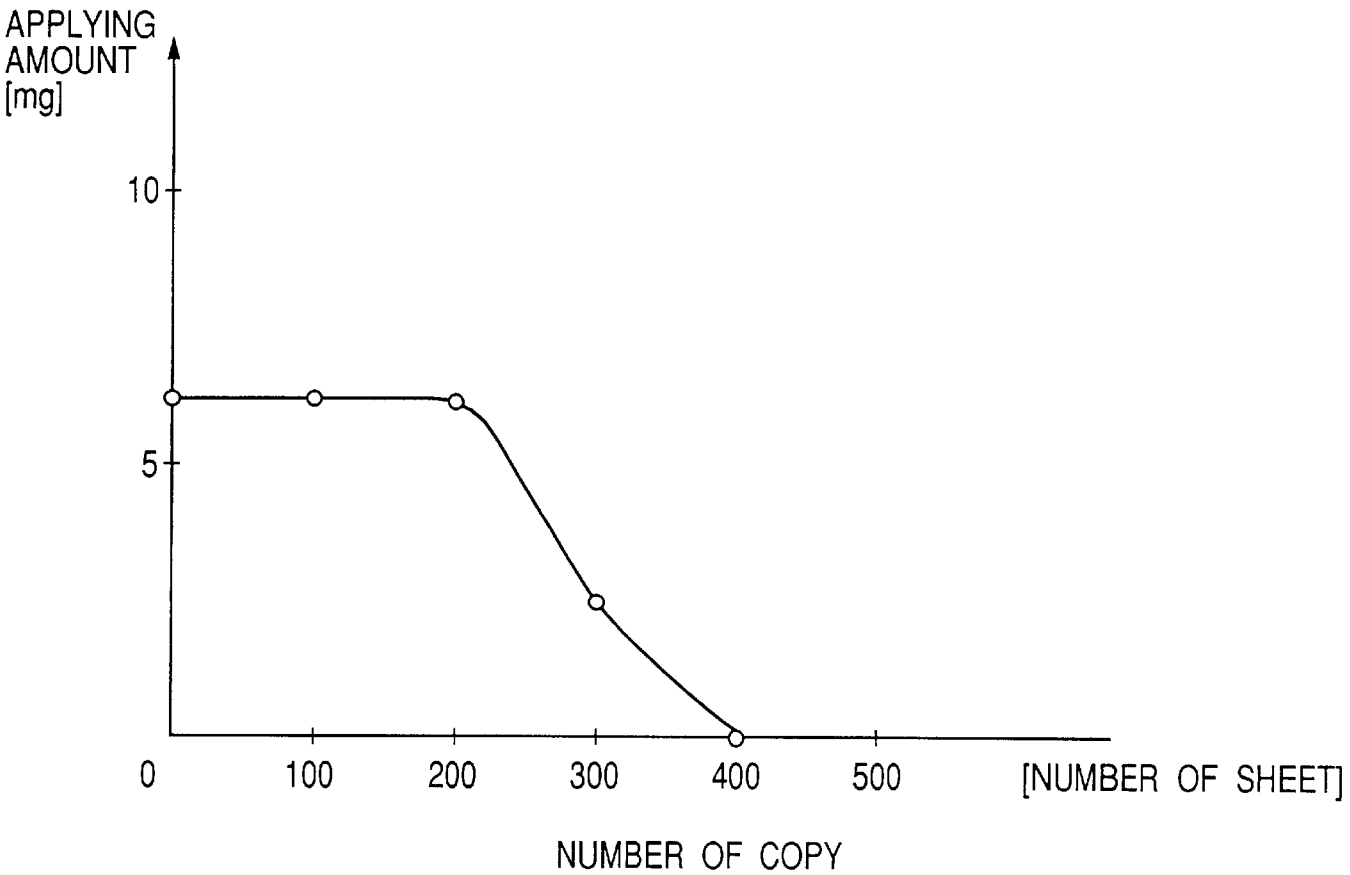
FIG. 4 is a graph showing a relationship between an oil applying amount and the number of copies.

FIG. 3 shows a relationship between viscosity [cst] [cS] of oil and an applying amount [mg] per one white paper sheet having A4 size. Incidentally, the viscosity is a value measured at a roller temperature of 170° C.

Further, the oil applying amount obtained by the oil applying device 100 is sought as follows.

First of all, it is assumed that a weight of ten white paper sheets having A4 size is A1 (g=grams) and a weight of the ten white paper sheets after passed between the fixing roller and the pressure roller without transferring images onto the white paper sheets and without applying oil onto the rubber layer of the fixing roller is B (g). Then, similarly, it is assumed that a weight of other ten white paper sheets having A4 size is A2 (g) and a weight of the ten white paper sheets after passed between the fixing roller and the pressure roller without transferring images onto the white paper sheets and with applying oil onto the rubber layer of the fixing roller is C (g). By using these values A1, B, A2 and C, the oil applying amount X (g) per one white paper sheet having A4 size is calculated by the following equation:

$$X=(C+A1-B-A2)/10.$$

In the illustrated embodiment, the oil is supplied from the pump to the oil dripping pipe 101 and accordingly the cleaning felt 102 is periodically, i.e., every several fixing processes. Incidentally, one fixing process means the fixing operation for one recording material.

The cleaning felt 102 disposed at the upstream side of the regulating blade 103 absorbs the oil to some extent. The cleaning felt 102 according to the illustrated embodiment is formed from a felt plate having a dimension of 30 cm×2 cm×0.3 cm. In this case, the felt can hold oil of about 10 grams.

In consideration of the above, the cleaning felt 102 holding oil of 10 grams was used and the regulating blade 103 was arranged at the downstream side of the felt, and a relationship between the applying amount and the number of sheets was examined by passing the sheets through the fixing apparatus without applying the oil from the pump. As a result, as shown in FIG. 4, it was found that the applying amount starts to be decreased from passing of about 200 sheets and becomes zero after passing of about 400 sheets.

From the above result, in the illustrated embodiment, when a sheet-to-sheet interval is relatively long as is in the full-color image formation, the oil is always replenished every passing of about 100 sheets to prevent the cold oil (oil having high viscosity) from passing through the regulating blade, thereby stabilizing the applying amount. Each oil applying time is selected to be shorter than a time required for each image formation.

Incidentally, in the illustrated embodiment, the temperature of the mold releasing agent to be applied is smaller than the surface temperature of the fixing roller, and the viscosity of the mold releasing agent is selected to be equal to or smaller than 200 cSt (cS) (centi-stokes) when the temperature of the agent is equal to the surface temperature of the fixing roller.

Figure 5:
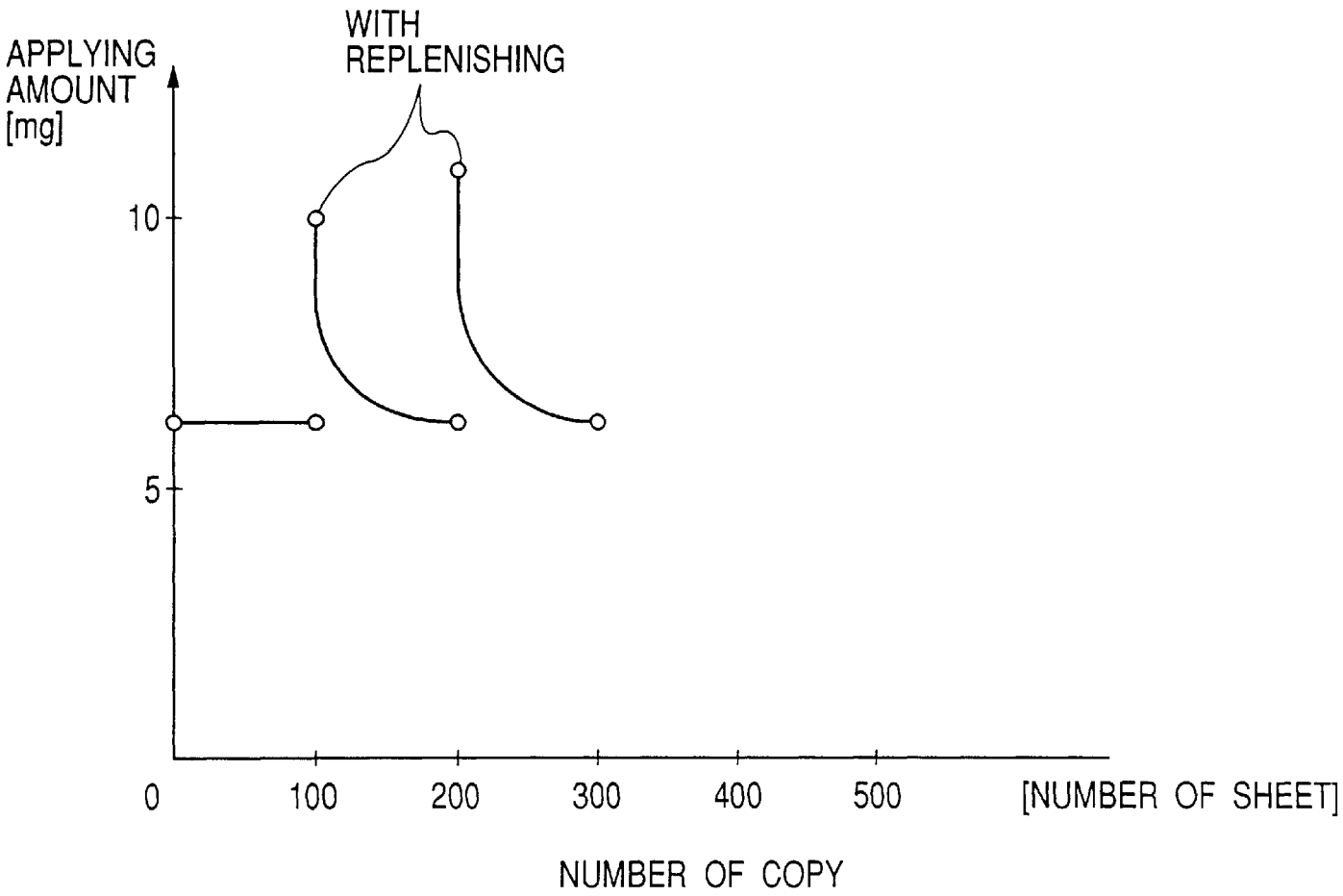
FIG. 5 is a graph showing a relationship between an oil applying amount and the number of copies when oil is replenished every 100 copies in a first embodiment of the present invention.

FIG. 5 shows a change in the actual applying amount when the oil was replenished every 100 sheets in the oil applying device 100 having the above-mentioned cleaning felt 102 and regulating blade 103. In this way, by replenishing the oil periodically rather than every time, the stable applying amount can be maintained.

As mentioned above, when the sheet-to-sheet interval is relatively long as is in the full-color image formation, the oil is replenished from the oil dripping pipe, for example, every passing of about 100 sheets, thereby stabilizing the applying amount.

Further, in a case where the illustrated embodiment is applied to a continuous copy mode, for example, as is in the mono-color image formation, when a sheet-to-sheet interval is short, since the replenishment of oil may not follow the copying speed to cause lack of oil, the oil replenishing timing is shortened (for example, the oil is replenished every 5 to 30 sheets), thereby stabilizing the applying amount.

Second embodiment

Next, a second embodiment of the present invention will be explained.

In case of an OHP sheet (film and the like), generally, a sheet-to-sheet interval becomes longer since the speed of the fixing process is reduced. In such a case, since there is no lack of oil on the fixing roller, there arises no problem even when the replenishment of oil from the oil dripping pipe is reduced. That is to say, when the OHP film mode is continued, by replenishing the oil every larger number of sheets (for example, 200 sheets or more) than the aforementioned number of sheets, the object of the present invention can be achieved.

Incidentally, in the above-mentioned embodiments, while an example that the present invention is applied to the fixing apparatus in which the oil regulating blade is directly contacted with the fixing roller was explained, the present invention may be applied to any fixing apparatus in which oil is applied to a roller.

As mentioned above, while the present invention was explained in connection with specific embodiments, the present invention is not limited to such embodiments, but various alteration can be made within the scope of the invention.

What is claimed is:

1. A fixing apparatus comprising:

a rotary member for thermally fixing a nonfixed image to a recording material; and a mold releasing agent applying means for applying a mold releasing agent to said rotary member, said mold releasing agent applying means including a regulating member contacted with said rotary member to regulate an amount of the mold releasing agent supplied to said rotary member, a holding member disposed at an upstream side of said regulating member in a rotating direction of said rotary member and adapted to hold the mold releasing agent, and a supplying member for supplying the mold releasing agent to said holding member, wherein said holding member is in contact with said rotary member and is stationarily fixed, and wherein a supplying timing of the mold releasing agent supplied from said supplying member to said holding member is effected periodically after a plurality of fixing process operations.

2. A fixing apparatus according to claim 1, wherein a temperature of the mold releasing agent supplied from said supplying member is lower than a surface temperature of said rotary member.

3. A fixing apparatus according to claim 1, wherein said supplying timing is varied with a kind of the recording material.

4. A fixing apparatus according to claim 1, wherein viscosity of the mold releasing agent held by said holding member is equal to or lower than 200 (cSt) when a temperature of the mold releasing agent is equal to a surface temperature of said rotary member.

* * * * *

UNITED STATES PATENT AND TRADEMARK OFFICE

CERTIFICATE OF CORRECTION

PATENT NO. : 6,266,509 B1
DATED : July 24, 2001
INVENTOR(S) : Mitsuhiro Ota et al.

It is certified that error appears in the above-identified patent and that said Letters Patent is hereby corrected as shown below:

Drawings,
Sheet S3, Fig. 3, "THEMPERATURE" should read -- TEMPERATURE --.

Column 2,
Line 18, "II" should read -- II, --.

Column 3,
Line 66, "lid," should read -- 11d, --; and
Line 67, "lie," should read -- 11e, --.

Column 4,
Line 26, "an" should read -- a --; and
Line 43, "an" should read -- a --.

Column 5,
Line 27, "lie" should read -- 11e --; and "lid." should read -- 11d. --.

Column 6,
Line 40, "a re" should read -- are --.

Signed and Sealed this

Thirtieth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,266,509 B1
DATED : July 24, 2001
INVENTOR(S) : Mitsuhiro Ota et al.

It is certified that error appears in the above-identified patent and that said Letters Patent is hereby corrected as shown below:

Title page,
Item [54], Title, "FIXING APPARATUS" should read -- FIXING APPARATUS WITH STABILIZED APPLICATION OF MOLD RELEASING AGENT --.

Signed and Sealed this

Thirtieth Day of July, 2002

*Attest:*

*Attesting Officer*

JAMES E. ROGAN
*Director of the United States Patent and Trademark Office*